United States Patent [19]

Aoki

[11] 4,287,836

[45] Sep. 8, 1981

[54] PALLET MADE OF SYNTHETIC RESIN

[75] Inventor: Hisashi Aoki, Kaiseimachi, Japan

[73] Assignee: Kabushiki Kaisha Meiji Gomu Kasei, Tokyo, Japan

[21] Appl. No.: 42,152

[22] Filed: May 24, 1979

[30] Foreign Application Priority Data

Jun. 3, 1978 [JP] Japan ..... 53-67100
Jun. 3, 1978 [JP] Japan ..... 53-67101

[51] Int. Cl.[3] ..... B65D 19/32

[52] U.S. Cl. ..... 108/51.1; 108/57.1; 108/901

[58] Field of Search ..... 108/51.1, 53.1, 53.3, 108/56.1, 56.3, 57.1, 901, 902; 206/386, 598, 599

[56] References Cited

U.S. PATENT DOCUMENTS 3,750,596 8/1973 Box ..... 108/53.1
4,013,021 3/1977 Steinlein et al. ..... 108/51.1

FOREIGN PATENT DOCUMENTS 2613083 10/1977 Fed. Rep. of Germany ..... 108/51.1
2703506 8/1978 Fed. Rep. of Germany ..... 108/52.1
2387850 12/1978 France ..... 108/51.1
1351363 4/1974 United Kingdom ..... 108/51.1

*Primary Examiner*—William E. Lyddane
*Attorney, Agent, or Firm*—Birch, Stewart, Kolasch & Birch

[57] ABSTRACT

A pallet made of synthetic resin and including four corner posts, intermediate posts therebetween, a center post, with hollow edge boards connecting the corner posts and the intermediate posts, and hollow deck boards connecting the intermediate posts and the center post. The pallet is formed from four identical complementary elements combined along two crossed division lines, each element provided with the above described hollow edge boards and hollow deck boards, each of which have flat walls provided at both ends thereof to form a closed hollow space therein. Reinforcing ribs are provided in the hollow space in each of the edge boards such that the reinforcing ribs extend parallel to the side surfaces of the pallet and are disposed such that the ribs meet with one another at right angles in the four corners of the pallet. The pallet is assembled by butt fusing the reinforcing ribs and upper and lower flat walls of the elements together.

7 Claims, 16 Drawing Figures

PALLET MADE OF SYNTHETIC RESIN

DETAILED DESCRIPTION OF THE INVENTION

The present invention relates to a pallet made of a synthetic resin used for the storage and transportation of freights or goods. More particularly, the present invention is directed to providing a pallet having a rib structure the strengths of the deck boards and the edge boards are well balanced.

In recent years, pallets made of synthetic resins have been utilized in place of wooden pallets for storing and/or transporting freights and various goods. With such pallets of synthetic resins, it is convenient, not only for reducing their weight and the cost required for production but also for increasing the strength thereof, to form them as hollow structures internally of which there are provided reinforcing ribs. These hollow structures are particularly improved in their increased bending strength.

On the other hand, the process for manufacturing the pallets of synthetic resin generally comprises the step of partitioning each pallet into several sections and the step of welding the partitioned sections to form an unitary body. The orientations of the reinforcing ribs forming the hollow structure of the pallet are defined depending upon the method of partitioning.

FIGS. 1 to 3 are, respectively illustrations showing the partition schemes and the reinforcing rib structures of the conventional pallets, wherein the bold dot-and-dash lines represent the parting planes.

In detail, the structure shown in FIG. 1 comprises four edge boards 11 and 12 (which may be further divided in the horizontal direction) and five to six deck boards, the edge boards having a hollow construction, and reinforcing ribs 11*a* and 12*a* being provided in the directions toward the respective opposing edge boards 11 and 12.

The structure shown in FIG. 2 comprises a plurality of parts partitioned along either the width direction X—X or the length direction Y—Y. The thus partitioned hollow edge boards 21 and 22 and the deck boards 23 and 24 are provided respectively with reinforcing ribs 21*a*, 22*a*, 23*a* and 24*a* which extend perpendicularly to the parting planes.

In the structure shown in FIG. 3, the pallet is partitioned along the horizontal planes to form parts each having horizontally extending opposing faces, wherein the orientations of the reinforcing ribs may be freely determined.

However, as the partition schemes described above have the principal disadvantages which will be clarified in the following description, there is demand for the improvement thereof.

Specifically, the structure shown in FIG. 1 requires three or four different types of molds and five or six parts must be assembled by three or four welding steps, so that the welding steps and the expenses for the molds are increased. Moreover, the pallet becomes heavy since the deck boards 13 and 14 can not be constructed as hollow members. Furthermore, since the reinforcing ribs 11*a* and 12*a* for the edge boards 11 and 12 are oriented perpendicularly to the bending direction, they do not serve as fully effective reinforcing ribs.

The structure shown in FIG. 2 is advantageous in that all the structural parts thereof may be formed as hollow structures which may be assembled by a single welding operation. Nevertheless, it requires three different molds, thereby raising the production cost, and is disadvantageous in that, although it resists bending or flexion in the width direction X—X, it does not have enough resistance in the length direction Y—Y since the reinforcing ribs 21*a*, 22*a*, 23*a* and 24*a* are oriented in a single direction.

The partition scheme as shown in FIG. 3 is advantageous in that all of the parts may be formed as hollow structues as in the structure shown in FIG. 2 and the reinforcing ribs may be oriented in any desired direction thereby to maintain sufficient strength in any bending direction. Nevertheless, it is disadvantageous in that the welding steps and the number of the molds are large in number and the dimensions of the parts are also large, thereby necessitating a larger molding machine and molding dies to considerably increase the cost.

The present invention provides a method of partitioning a pallet made of a synthetic resin, as well as a reinforcing rib construction of the edge board (and/or deck board) which eliminate the problems encountered in the prior art, and has as its object to provide a pallet wherein the bending strengths in the width and length directions are well balanced and the pallet may be assembled to form a unitary body by a single welding operation or step.

The present invention comprises four parts partitioned or divided by two parting lines which cross each other, at least the reinforcing ribs of the edge boards of the parts being formed in parallel with the end faces which constitute the side faces of the pallet.

The above and other objects and advantages of the present invention will be fully understood in view of the description with reference to FIGS. 4 to 15.

Figure 1:
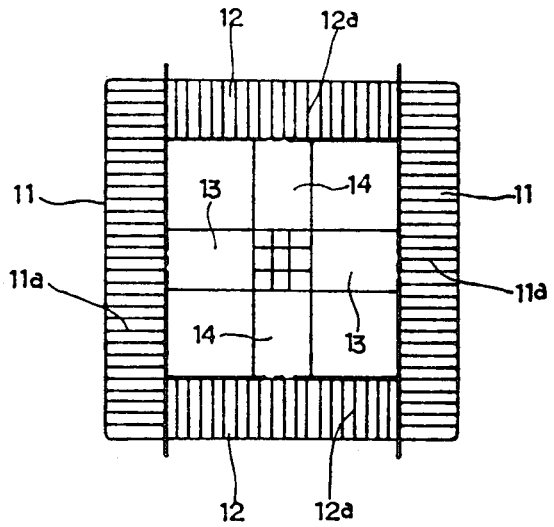
Fig. 1 PRIOR ART
Figure 2:
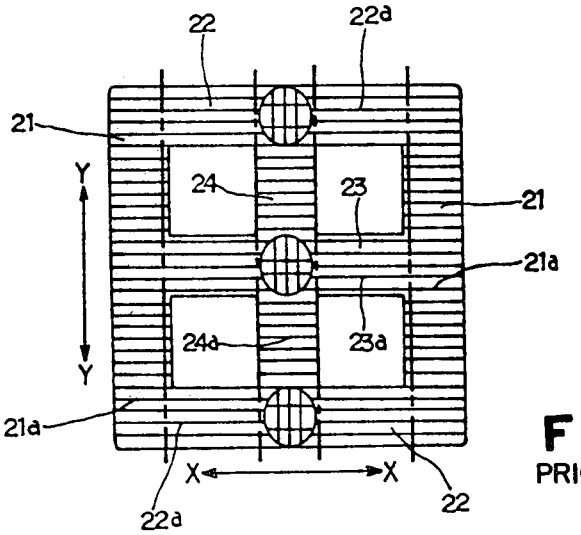
Fig. 2 PRIOR ART
Figure 3:
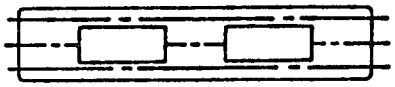
Fig. 3 PRIOR ART
Figure 4:
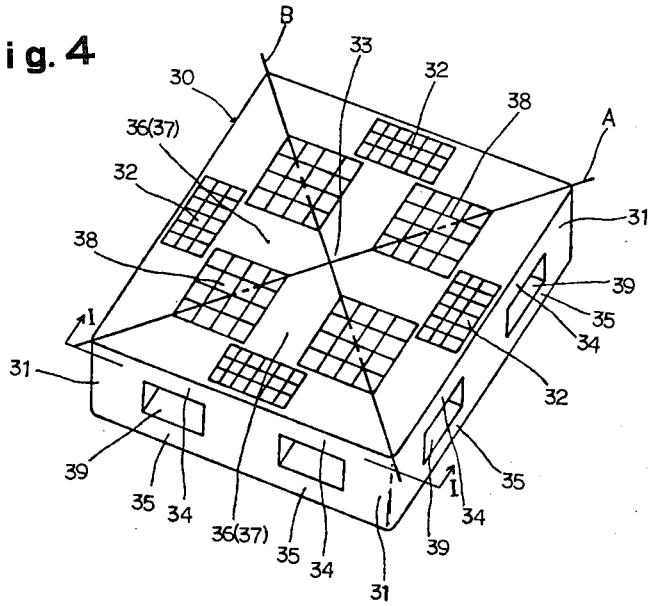
FIG. 4 is a perspective view of a pallet showing an embodiment composed of four triangular parts equally divided by two parting lines extending diagonally of the pallet.
Figure 5:
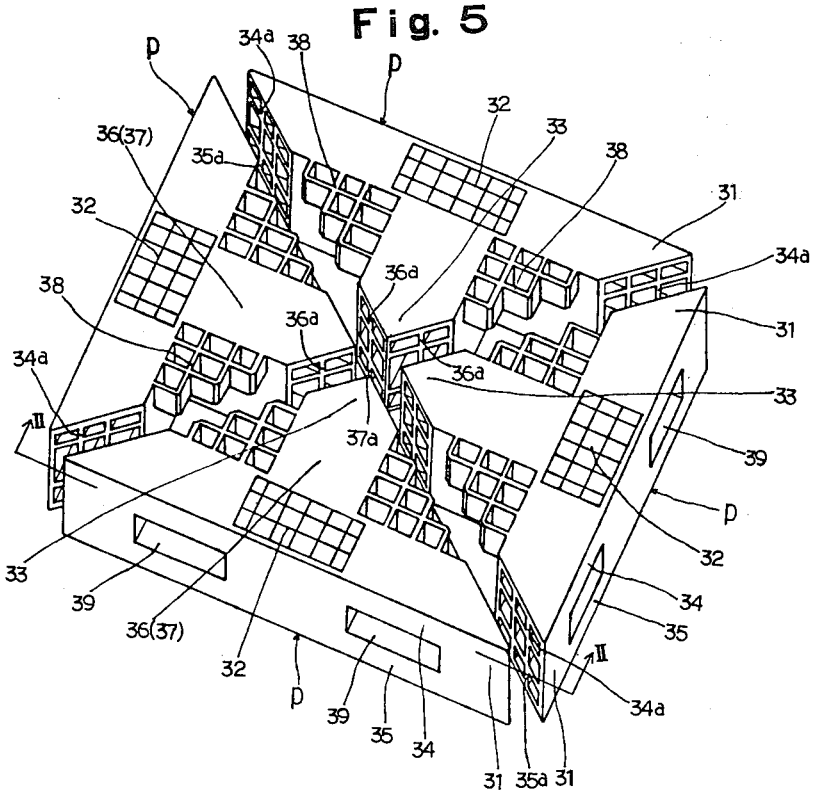
FIG. 5 is a view showing the arrangement of respective parts.
Figure 14:
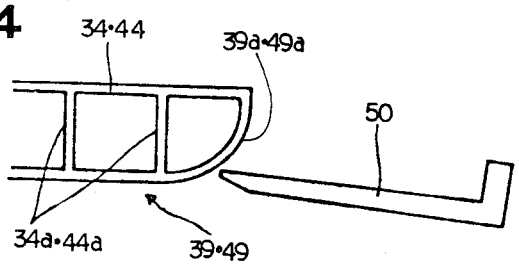
FIG. 14 is a partial section showing the end face of an edge board at the upper portion of a fork insertion hole.
Figure 15:
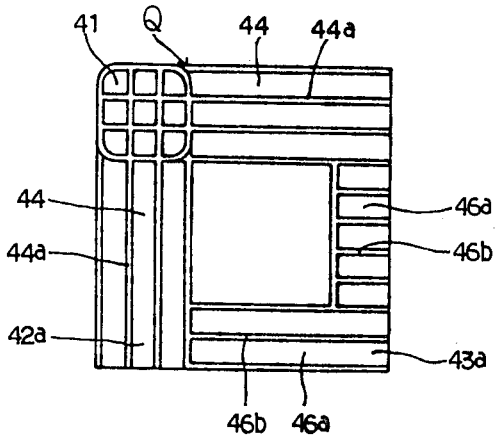
FIGS. 15 and 16 are illustrative sectional views showing yet further embodiments of the invention.
Figure 16:
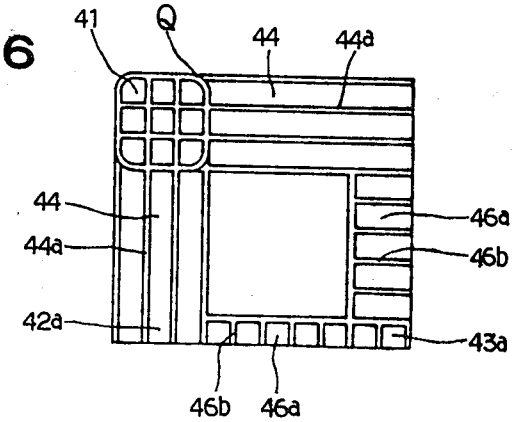

FIG. 4 is a perspective view showing a pallet of the present invention which is formed by mutually welding four triangular parts P divided by the parting lines A and B extending diagonally of the pallet and crossing at the substantial center thereof as shown in FIG. 5 to form an unitary body. A pallet 30 comprises struts 32 and central struts 33 extending from the top to the bottom surfaces of the pallet; unitary hollow structures interposed between each of the struts and each including a top edge board 34, a bottom edge board 35, a top deck board 36 and a bottom deck board 37; a grating 38 enclosed by the top edge boards 34 and the top deck boards 36 a plurality of fork insertion holes 39 being provided therein. The upper opening end 39*a* for the fork insertion hole 39 of each top edge board 34 is arc-shaped as shown in FIG. 14 so as to facilitate the insertion of a fork 50 and simultaneously to prevent the pallet from being damaged by the inserted fork.

The structure of the triangular part P shown in FIG. 5 et seq of the drawings will now be described. The component part P is formed by being quartered by the diagonally extending parting lines A and B so that the strut 31 is divided into two equal parts and the central strut 33 into four equal parts which project toward the center of the pallet.

Figure 6:
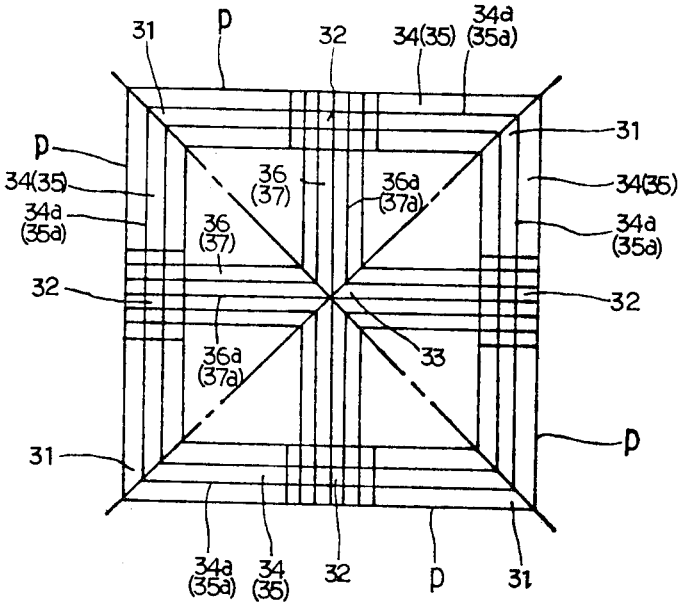
FIG. 6 is a sectional view taken along line I—I in FIG. 4.
Figure 7:
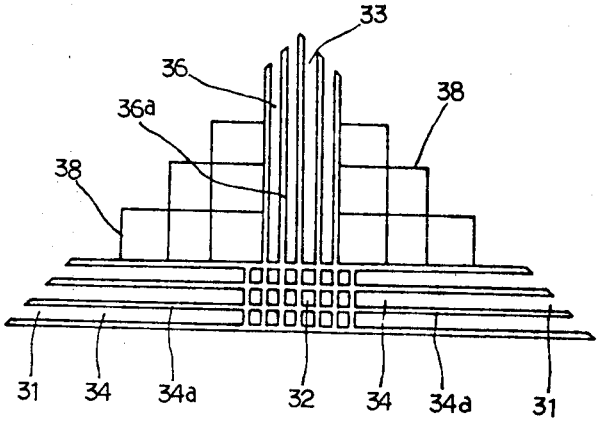
FIG. 7 is a sectional view taken along line II—II in FIG. 5.
Figure 8:
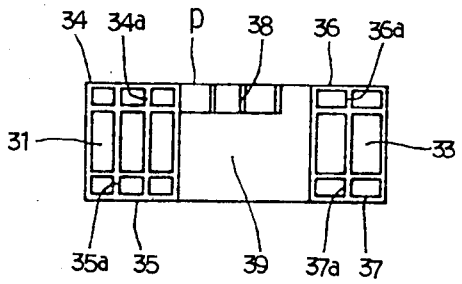
FIG. 8 is a side elevational view showing the welded faces of the parts shown in FIG. 5.

The edge boards 34 and 35 have hollow constructions, and reinforcing ribs 34*a* and 35*a* are oriented parallel to the side faces which form the outer contour of the pallet, and extending perpendicular to the reinforcing ribs of the adjacently disposed part component. The reinforcing ribs 34*a* and 35*a* are, thus, formed along the periphery of the pallet 30, and the reinforcing ribs of the opposingly disposed component parts are parallel to each other. On the other hand, reinforcing ribs 36*a* and 37*a* in the deck boards 36 and 37 are oriented toward the central strut and thus cross the reinforcing ribs 34*a* and 35*a* at right angles and form crossing figures at the center of the pallet when welded together (reference should be made to FIGS. 6 and 7).

Four component parts having the structures as mentioned above are, as shown in FIG. 5, arranged while abutting their apexes that form the central strut, and then heated by a cross- or X-shaped hot plate inserted to heat the faces to be welded, after which the faces to be welded are pressed against each other after lifting the hot plate off thereby welding the component parts together to form a unitary body by a single welding operation or step.

Figure 9:
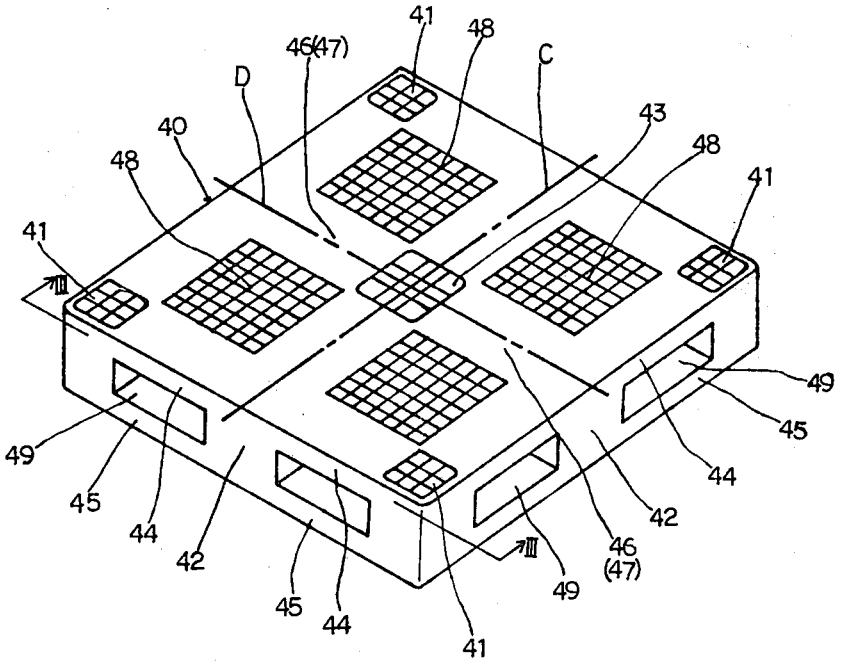
FIG. 9 is a perspective view of a pallet showing another embodiment composed of four square parts divided by two parting lines extending parallel to the side end of the pallet and crossing each other perpendicularly.
Figure 10:
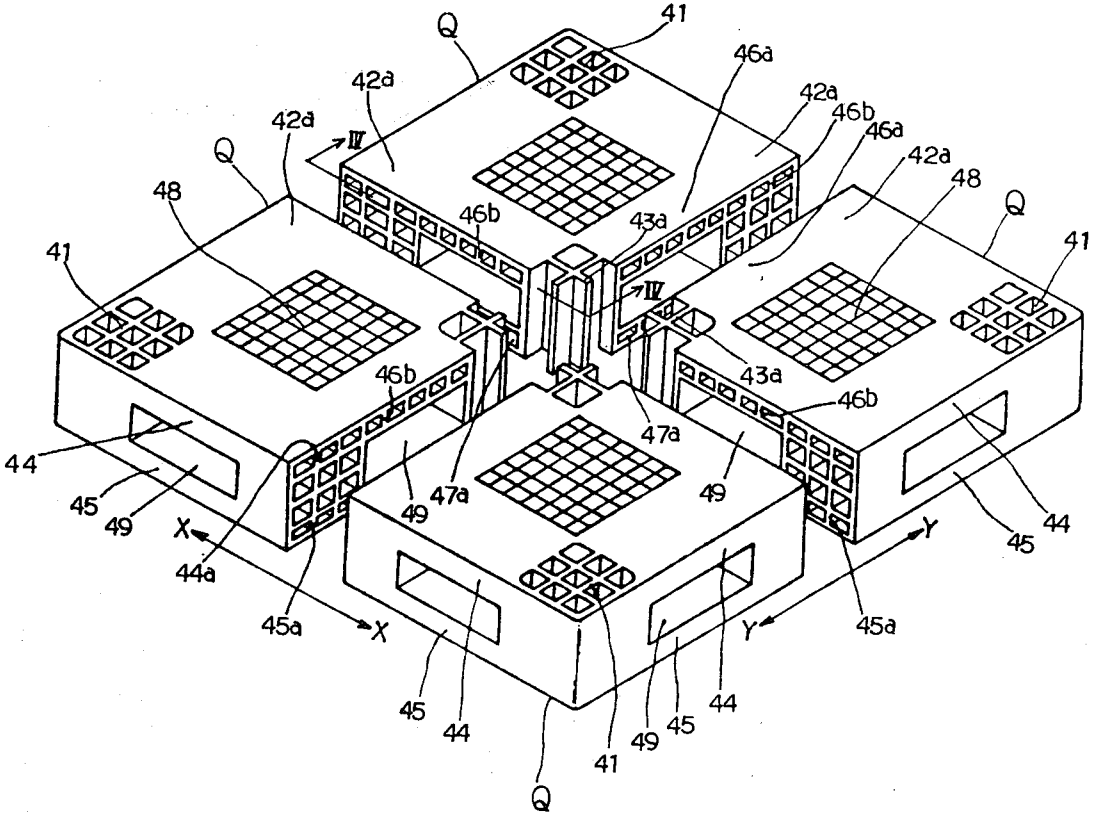
FIG. 10 is a view showing the arrangement of respective parts.

FIG. 9 is a perspective view showing another embodiment of the pallet according to the present invention, which comprises a unitary body formed by mutually welding four square parts Q quarterly divided by two parting lines C and D extending through the approximate center of the pallet and crossing each other at a right angle as shown in FIG. 10. The pallet 40 comprises struts 41 disposed at the four corners thereof; intermediate struts 42 and the center strut 43, the struts 31 and 43 extending from the top face to the bottom face of the pallet; a hollow structure including top edge boards 44, bottom edge boards 45, top deck boards 46 and bottom deck boards 47; and a grating 48 enclosed by the top edge boards 44 and the top deck boards 46, a plurality of fork insertion holes 49 being provided therein. The upper opening end 49*a* for the fork insertion hole 39 of each top edge board 44 is arc-shaped as shown in FIG. 14 so as to facilitate the insertion of a fork 50 and simultaneously to prevent the pallet from being damaged by the inserted fork.

The structure of the square part Q will now be described. Each part Q comprises, as is clearly shown in FIGS. 10 to 13, the strut 41 disposed at each of the four corners thereof, an equally halved intermediate strut 42*a*, a quartered central strut 43*a*, the top and bottom edge boards 44 and 45 for forming the outer periphery of the pallet 40, a top deck board 46*a* and bottom deck board 47*a* equally halved for forming the internal frame, and the grating portion 48, the fork insertion through-holes 49 extending to the other end being formed therein.

Figure 11:
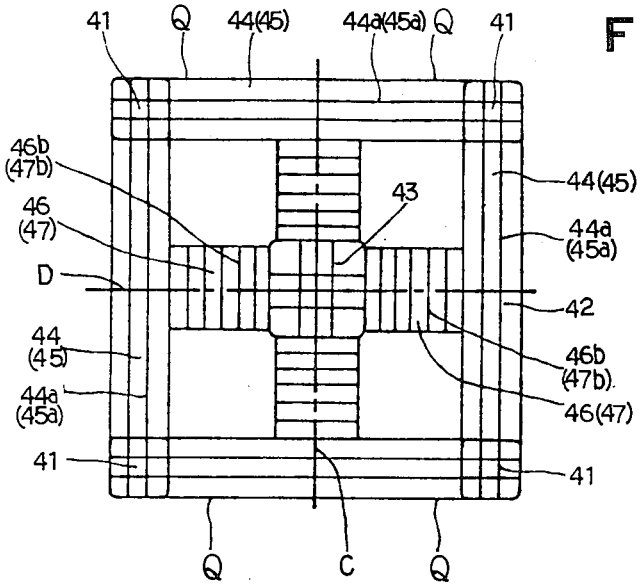
FIG. 11 is a sectional view taken along line III—III in FIG. 9.
Figure 13:
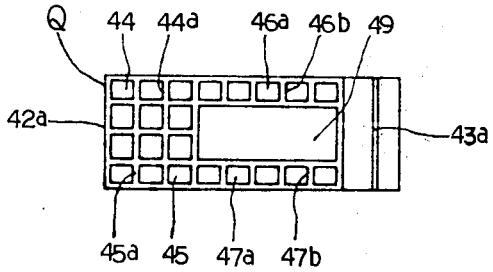
FIG. 13 is a side elevational view showing the welded faces of the parts shown in FIG. 10.
Figure 12:
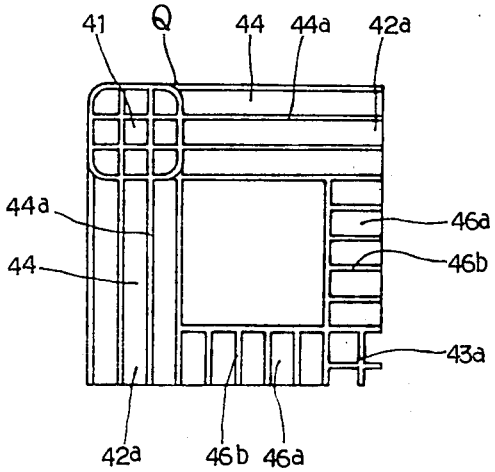
FIG. 12 is a sectional view taken along line IV—IV in FIG. 10.

Provided in the edge boards 44 and 45 are reinforcing ribs 44*a* and 45*a* which are, as shown in FIGS. 11 and 12, oriented perpendicularly to the direction of the adjacent component part, i.e. perpendicularly to the parting planes or welding faces, and crossing one another. On the other hand, reinforcing ribs 46*a* and 47*a* of the deck boards 46 and 47 are similarly oriented perpendicularly to the parting planes or welding faces, i.e. in the same direction as the reinforcing ribs 44*a* and 45*a* of the corresponding edge boards.

Four parts having the structures as mentioned above are, as shown in FIG. 10, arranged while positioning the center struts 43*a* at the center position, and then heated to weld them by inserting a cross-shaped hot plate to heat the faces to be welded to form the pallet 40 by a single welding operation. Concurrently, the reinforcing ribs of the edge boards and the deck boards are integrally welded together as shown in FIG. 11. Meanwhile, in order to obtain the structure wherein the central strut 43 does not extend throughly from the top to the bottom faces, the reinforcing ribs of the strut 43 are oriented in the same direction as the reinforcing ribs of either of the deck boards.

The feature of the present invention is not limited only to the aforementioned embodiments, but may be applied to either a double-sided pallet or single-sided pallet and also may be applied to a rectangular pallet having dimensions different in the length direction and width direction. Furthermore, the parting lines A and B or C and D are not limited to those pairs which cross at the center of the pallet but may be pairs of lines which partition the pallet into pairs of lines which cross one another and divide or partition the pallet into four sections or parts.

The pallet of the present invention is constituted as described above and thus has the following specific effects.

(1) Since each of the structural elements may be composed of hollow structures, the weight of the pallet can be lightened and the molding cycle for the production thereof shortened.

(2) Since the dimensions of the component parts to be welded are decreased by partitioning the same, large scale molding machines and molding dies as used conventionally are dispensed with, whereby the installation cost and the accompanying expenses are reduced to result in considerable reduction in cost.

(3) Each of the parts to be welded is formed by dividing the pallet into four equal triangular or square elements, so that only one or two varieties of the parts are molded to make it easy to control the parts and to minimize the number of molding dies.

(4) The reinforcing ribs of the edge boards and deck boards are disposed parallel to the bending or flexion directions either in the width and length directions to balance the strengths, whereby a pallet superior in its load bearing property can be formed.

(5) Due to the fact that the component parts are divided respectively by crossing lines, they may be fixed together to form an integral body by a single welding operation or step by locating and arranging them from the front and rear and the left and right directions to being the apexes thereof into coincidence at one point. Moreover, full operation may be realized, thereby resulting in enhancement of efficiency and reduction is cost.

What is claimed is:

1. A pallet made of a synthetic resin and comprising four corner posts, intermediate posts provided between said corner posts, a center post, hollow edge boards connecting said corner posts and said intermediate posts, hollow deck boards provided in a crossed manner to connect said intermediate posts and said center post together, and fork inserting openings provided at the four sides of said pallet, wherein four identical complementary pallet elements are combined together along two crossed division lines on said pallet, said elements being provided with edge boards and deck boards, with flat walls provided at both ends of each of said edge boards and deck boards so as to form a closed hollow space in each of said elements, and reinforcing ribs provided in the hollow space in each of said edge boards such that said reinforcing ribs are extended in parallel with the side surfaces of said pallet and disposed such that said reinforcing ribs meet with one another at right angles in the four corners of said pallet, said reinforcing ribs and said upper and lower flat walls in each of said pallet elements being butt fused together.

2. The pallet as claimed in claim 1, wherein said two crossed division lines intersect at the approximate center of the pallet.

3. The pallet as claimed in claims 1 or 2, wherein the pallet comprises four triangular sections produced by crossed division lines extending diagonally of the pallet.

4. The pallet as claimed in claim 3, wherein each of the reinforcing ribs of the deck boards of each sections cross the reinforcing ribs of the edge boards at a right angle.

5. The pallet as claimed in claims 1 or 2, wherein the pallet comprises four square sections produced by crossed division lines extending parallel to the side ends of the pallet.

6. The pallet as claimed in claim 5, wherein each reinforcing rib of the deck boards of each section is oriented perpendicularly to the crossed division plane.

7. The pallet as claimed in claim 5, wherein each reinforcing rib of the deck boards of each section is oriented in the same direction as the reinforcing rib of either one of the edge boards.

* * * * *